US009443675B2

(12) United States Patent
Wu

(10) Patent No.: US 9,443,675 B2
(45) Date of Patent: Sep. 13, 2016

(54) KEYBOARD

(71) Applicant: Primax Electronics Ltd., Neihu, Taipei (TW)

(72) Inventor: Chu-Hsun Wu, Taipei (TW)

(73) Assignee: Primax Electronics Ltd., Taipei (TW)

( * ) Notice: Subject to any disclaimer, the term of this patent is extended or adjusted under 35 U.S.C. 154(b) by 125 days.

(21) Appl. No.: 14/558,369

(22) Filed: Dec. 2, 2014

(65) Prior Publication Data

US 2016/0118206 A1 Apr. 28, 2016

(30) Foreign Application Priority Data

Oct. 24, 2014 (TW) ..... 103136816 A

(51) Int. Cl.
*H01H 13/83* (2006.01)
*H01H 13/7065* (2006.01)
*H01H 13/10* (2006.01)

(52) U.S. Cl.
CPC ..... *H01H 13/83* (2013.01); *H01H 13/10* (2013.01); *H01H 13/7065* (2013.01); *H01H 2219/048* (2013.01); *H01H 2221/024* (2013.01); *H01H 2221/044* (2013.01)

(58) Field of Classification Search
CPC .. H01H 13/83; H01H 13/10; H01H 13/7065; H01H 13/52
USPC ..... 200/5 A, 245, 314
See application file for complete search history.

(56) References Cited

U.S. PATENT DOCUMENTS

2012/0097511 A1* 4/2012 Liu ..... H01H 3/125 200/5 A
2014/0166457 A1* 6/2014 Chen ..... H01H 13/83 200/5 A

* cited by examiner

*Primary Examiner* — Edwin A. Leon
*Assistant Examiner* — Iman Malakooti
(74) *Attorney, Agent, or Firm* — Kirton McConkie; Evan R. Witt

(57) ABSTRACT

A keyboard includes plural keys, a base plate and a backlight module. Each key includes a keycap and a sliding element. The keycap includes a first protrusion part. The sliding element includes a second protrusion part. The first protrusion part has a first slant surface. The second protrusion part has a second slant surface. The first slant surface and the second slant surface are in parallel with each other. When the keycap is depressed and moved toward the base plate, the first slant surface is moved along the second slant surface to push the sliding element to be moved relative to the base plate in a horizontal direction. Consequently, a light beam transmitted through the base plate is further transmitted through the sliding element and outputted from the keycap, or the light beam transmitted through the base plate is blocked by the sliding element.

26 Claims, 15 Drawing Sheets

KEYBOARD

FIELD OF THE INVENTION

The present invention relates to a keyboard, and more particularly to a keyboard with an illuminating function.

BACKGROUND OF THE INVENTION

A keyboard is one of the widely-used computer peripheral devices. Via the keyboard, the user may input characters or commands into a computer. With increasing development of science and technology, the keyboard manufacturers make efforts in designing novel keyboards with diversified functions in order to meet the requirements of different users. Recently, an illuminated keyboard with an illuminating function has been introduced into the market. Consequently, in a case that the illuminated keyboard is used in the dim environment with insufficient luminance, the characters marked on the keys of the illuminated keyboard are still clearly visible to the user.

Hereinafter, the structure of a conventional illuminated keyboard will be illustrated with reference to FIG. 1. FIG. 1 is a schematic cross-sectional view illustrating a conventional illuminated keyboard.

Firstly, the components of the conventional illuminated keyboard are described. As shown in FIG. 1, the conventional illuminated keyboard 1 comprises at least one key 11, a membrane switch circuit module 12, a base plate 13, and a backlight module 14.

The key 11 comprises a keycap 111, an upward/downward supporting member 112 and an elastic element 113. Moreover, the membrane switch circuit module 12 comprises an upper wiring plate 121 and a lower wiring plate 122. An upper contact 121*a* is formed on the upper wiring plate 121. Corresponding to the upper contact 121*a*, a lower contact 122*a* is formed on the lower wiring plate 122. Moreover, the backlight module 14 comprises a light guide plate 141, a reflective plate 142 and a light-emitting element 143.

The operating principle of the key 11 of the conventional illuminated keyboard 1 will be illustrated in more details as follows. Firstly, the upward/downward supporting member 112 of the key 11 is connected with the keycap 111 and the base plate 13. The elastic element 113 is disposed within the upward/downward supporting member 112, and arranged between the keycap 111 and the base plate 13. The membrane switch circuit module 12 is arranged between the elastic element 113 and the base plate 13.

As the key 11 is depressed, the keycap 111 is correspondingly moved with the upward/downward supporting member 112 in a vertical direction toward the base plate 13, and the membrane switch circuit module 12 is pushed by a protrusion part 113*a* within the elastic element 113. Under this circumstance, the upper contact 121*a* and the lower contact 122*a* of the membrane switch circuit module 12 are contacted with each other to be electrically conducted. Consequently, a corresponding input function is executed.

The illuminating principles of the conventional illuminated keyboard 1 will be illustrated as follows. Firstly, the light guide plate 141 is disposed under the base plate 13, and the reflective plate 142 is disposed under the light guide plate 141. The light-emitting element 143 is located at a side of the light guide plate 141. The light-emitting element 143 may emit a light beam. The light beam is introduced into the light guide plate 141 and guided by the light guide plate 141. Moreover, the light beam emitted by the light-emitting element 143 is reflected by the reflective plate 142, so that the light beam is transferred within the light guide plate 141 more uniformly. Moreover, a portion of the light beam is projected upwardly through a base plate opening 131 of the base plate and a light-transmissible part of the keycap 111 so as to result in the illuminating efficacy.

From the above, the key 11 of the conventional illuminated keyboard 1 is selectively illuminated by controlling the on/off states of the light-emitting element 143. In other words, it is inconvenient for the user to manually turn on or turn off the light-emitting element 143. In case that a complicated circuitry and a sensing device are installed in the conventional illuminated keyboard 1, the light-emitting element 143 may be automatically turned on or turned off during the period of using the illuminated keyboard 1. However, the additional design of the complicated circuitry and the sensing device may increase the fabricating cost and the process complexity. Moreover, for changing the color of the light beam, it is necessary to employ another light source to emit the corresponding color light. Under this circumstance, the fabricating cost is further increased.

Therefore, there is a need of providing an improved illuminated keyboard in order to overcome the above drawbacks.

SUMMARY OF THE INVENTION

The present invention provides an illuminated keyboard for controlling the illuminating state or changing the outputted light color by depressing the key.

In accordance with an aspect of the present invention, there is provided a keyboard. The keyboard includes plural keys, a base plate and a backlight module. Each key includes a keycap and a sliding element. The keycap includes at least one first protrusion part. The first protrusion part has a first slant surface. The sliding element is disposed under the keycap and comprising at least one second protrusion part. The second protrusion part has a second slant surface. The first slant surface and the second slant surface are in parallel with each other. The base plate is disposed under the plural sliding elements of the plural keys and limits positions of the plural sliding elements. The base plate includes plural perforations corresponding to the plural sliding elements. The backlight module is disposed under the base plate and emits a light beam to the base plate. When one of the plural keycaps is depressed and moved toward the base plate, the first slant surface is moved along the second slant surface to move the sliding element to be moved relative to the base plate in a horizontal direction. Consequently, the light beam transmitted through the corresponding perforation of the base plate is further transmitted through the sliding element and outputted from the keycap, or the light beam transmitted through the corresponding perforation of the base plate is blocked by the sliding element.

In accordance with another aspect of the present invention, there is provided a keyboard. The keyboard includes plural keys, a base plate and a backlight module. Each key includes a keycap, a first sliding element and a second sliding element. The keycap includes a first protrusion part and a second protrusion part. The first protrusion part has a first slant surface. The second protrusion part has a second slant surface. The second slant surface and the first slant surface are inclined in different directions. The first sliding element is disposed under the keycap and comprising a third protrusion part. The third protrusion part has a third slant surface. The third slant surface and the first slant surface are in parallel with each other. The second sliding element is disposed under the keycap and includes a fourth protrusion part. The fourth protrusion part has a fourth slant surface. The fourth slant surface and the third slant surface are inclined in different directions. The fourth slant surface and the second slant surface are in parallel with each other. The base plate is disposed under the plural first sliding elements and the plural second sliding elements of the plural keys and limits positions of the plural first sliding elements and the plural second sliding elements. The base plate includes plural perforations corresponding to the plural keys. The backlight module is disposed under the base plate and emits a light beam to the base plate. When one of the plural keycaps is depressed and moved toward the base plate, the first slant surface is moved along the third slant surface and the second slant surface is moved along the fourth slant surface so as to push the first sliding element and the second sliding element to be moved relative to the base plate in a horizontal direction. Consequently, the light beam transmitted through at least one of the plural perforations of the base plate is further transmitted through the first sliding element or the second sliding element and outputted from the keycap, or the light beam transmitted through at least one of the plural perforations of the base plate is blocked by the first sliding element or the second sliding element.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
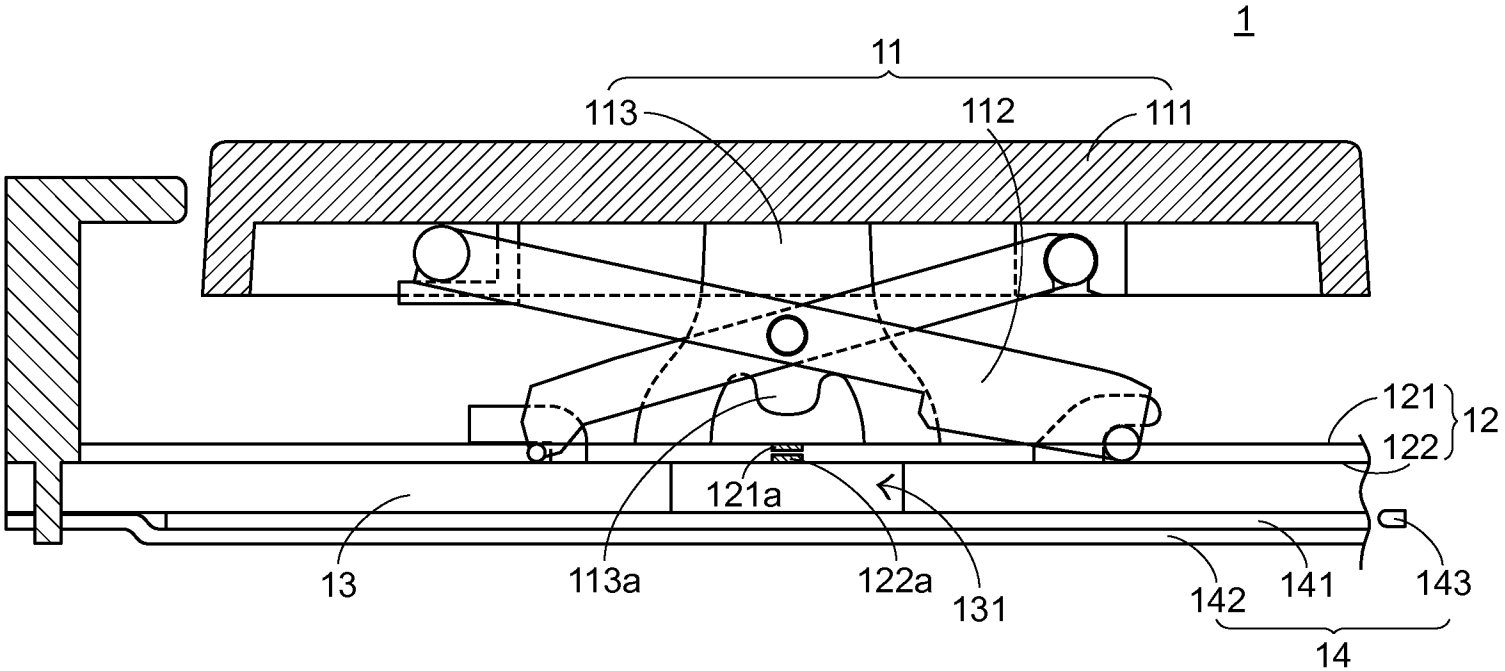
FIG.1 PRIOR ART
FIG. 1 is a schematic cross-sectional view illustrating a conventional illuminated keyboard.
Figure 2:
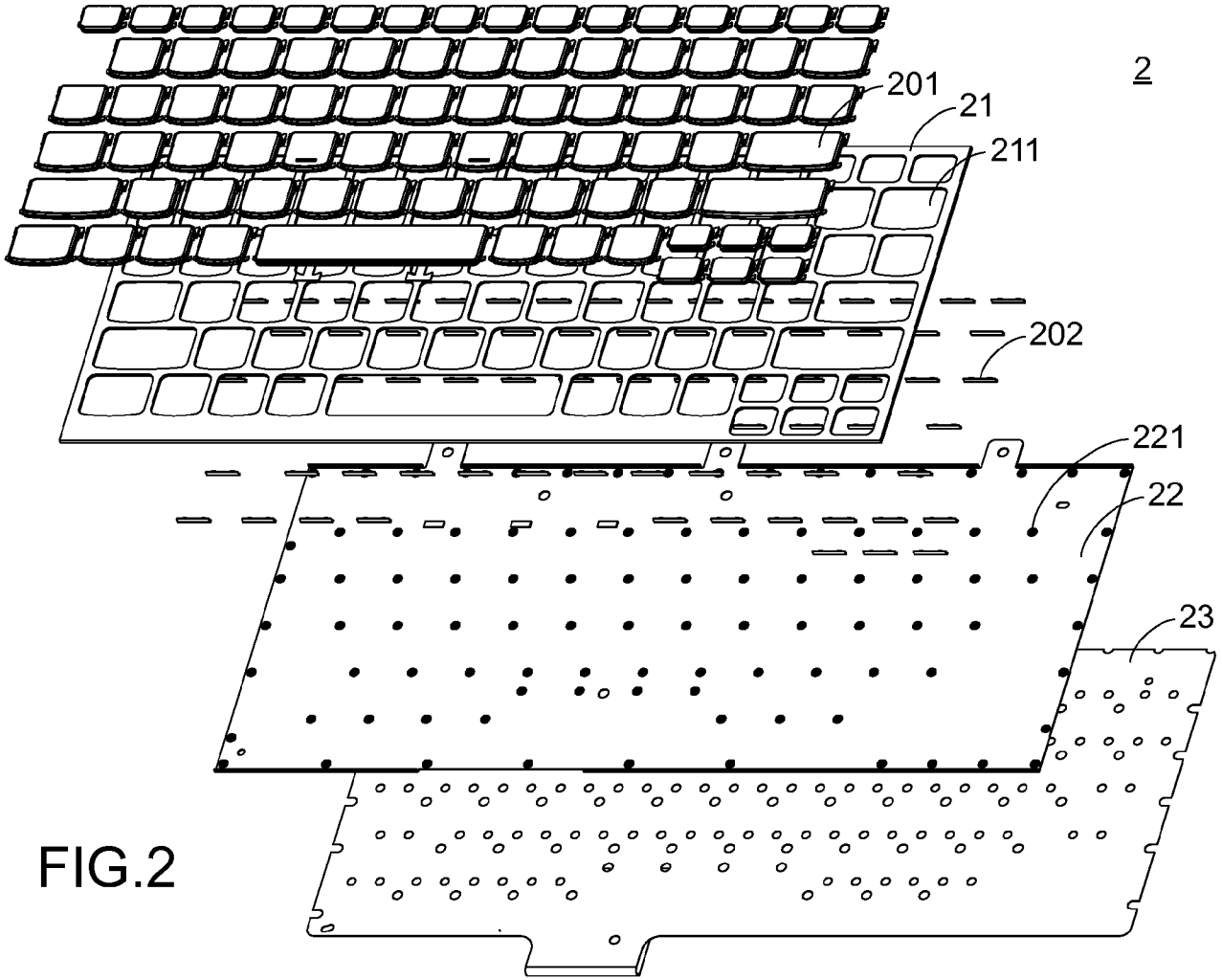
FIG. 2 is a schematic exploded view illustrating a keyboard according to a first embodiment of the present invention.
Figure 3:
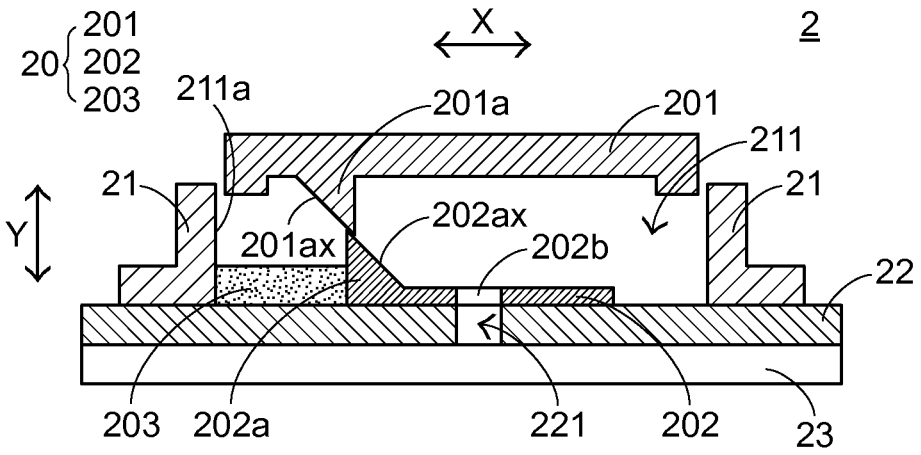
FIG. 3 is a schematic cross-sectional view illustrating the keyboard in a first operating state according to the first embodiment of the present invention.

The present invention provides a keyboard 2 according to a first embodiment of the present invention. Hereinafter, the components of the keyboard 2 according to the first embodiment of the present invention will be illustrated with reference to FIGS. 2 and 3. FIG. 2 is a schematic exploded view illustrating a keyboard according to the first embodiment of the present invention. FIG. 3 is a schematic cross-sectional view illustrating the keyboard in a first operating state according to the first embodiment of the present invention.

The keyboard 2 comprises plural keys 20, a frame 21, a base plate 22 and a backlight module 23. Each key 20 comprises a keycap 201, a sliding element 202 and an elastic element 203. The structure and operating principle of the backlight module 23 are similar to those of the commercially available keyboard, and are not redundantly described herein.

The sequence of assembling the keyboard 2 will be illustrated as follows. Firstly, the base plate 22 is disposed on the backlight module 23, and the frame 21 is disposed on the base plate 22. The frame 21 comprises plural openings 211. Each opening 211 is aligned with the corresponding key 20.

The plural sliding elements 202 are disposed within the plural openings 211, respectively. Each elastic element 203 is disposed within the corresponding sliding element 202 and a corresponding sidewall 211*a*. Moreover, the base plate 22 may comprise plural guiding grooves (not shown) corresponding to the plural sliding elements 202, respectively. Consequently, the sliding elements 202 can be moved within specified regions and relative to the base plate 22 in a horizontal direction, which is indicated by a double-headed arrow X (see FIG. 3).

The plural keycaps 201 are disposed over the plural sliding elements 202, respectively. Moreover, the plural keycaps 201 are connected with the frame 21 around the openings 211 or connected with the base plate 211 underlying the openings 211. Consequently, the keycaps 201 are only able to be moved relative to the base plate 22 in a vertical direction, which is indicated by a double-headed arrow Y (see FIG. 3). That is, the keycaps 201 cannot be moved relative to the base plate 22 in the horizontal direction.

Please refer to FIG. 3 again. Each keycap 201 comprises a first protrusion part 201*a*. The first protrusion part 201*a* has a first slant surface 201*ax*. Moreover, each sliding element 202 comprises a second protrusion part 202*a*. The second protrusion part 202*a* has a second slant surface 202*ax*. The first slant surface 201*ax* and the second slant surface 202*ax* are in parallel with each other and contacted with each other.

Figure 4:
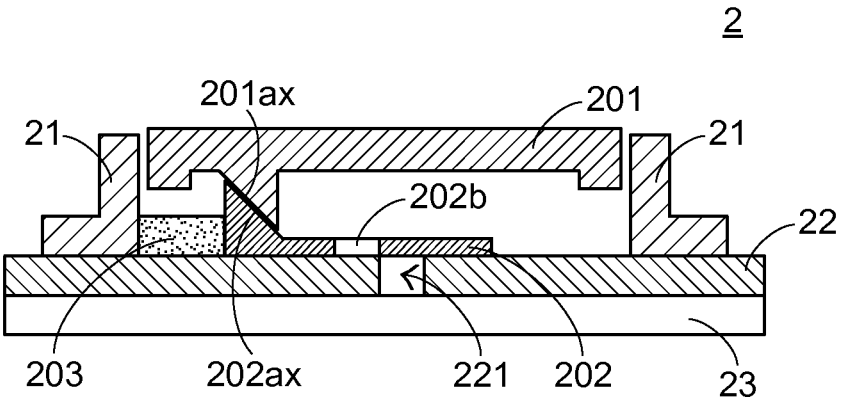
FIG. 4 is a schematic cross-sectional view illustrating the keyboard in a second operating state according to the first embodiment of the present invention.

The illuminating principles of the keyboard 2 of this embodiment will be illustrated with reference to FIGS. 3 and 4. FIG. 4 is a schematic cross-sectional view illustrating the keyboard in a second operating state according to the first embodiment of the present invention.

As shown in FIGS. 3 and 4, the base plate 22 further comprises plural perforations 221 corresponding to the plural sliding elements 202, respectively. Each sliding element 202 further comprises a first light-transmissible zone 202*b*. When the keycap 201 is not depressed (i.e. in the first operating state as shown in FIG. 3), the first light-transmissible zone 202*b* is overlapped with the corresponding perforation 221. Under this circumstance, a portion of a light beam emitted by the backlight module 23 is projected upward through the perforation 221 of the base plate 22 and the first light-transmissible zone 202*b* and then outputted from the keycap 201. Consequently, the illuminating efficacy is achieved.

When any keycap 201 is depressed (i.e. in the second operating state as shown in FIG. 4), the keycap 201 is moved toward the base plate 22 in the vertical direction. Consequently, the first slant surface 201*ax* is moved along the second slant surface 202*ax*. As the first slant surface 201*ax* is moved along the second slant surface 202*ax*, the sliding element 202 is moved relative to the base plate 22 in the horizontal direction. Consequently, the first light-transmissible zone 202*b* is no longer overlapped with the corresponding perforation 221. Under this circumstance, the portion of the light beam emitted by the backlight module 23 and projected upward through the perforation 221 of the base plate 22 will be blocked by the sliding element 202. Meanwhile, the light beam cannot be outputted from the keycap 201, so that the illuminating efficacy is not achieved.

Moreover, while any keycap 201 is depressed, the sliding element 202 is moved relative to the base plate 22 in the horizontal direction so as to compress the elastic element 203. Consequently, the elastic element 203 is in a compressed state (see FIG. 4). When the keycap 201 is no longer depressed, the elastic element 203 is restored to a released state. Consequently, the sliding element 202 is moved to the original position as shown in FIG. 3. At the same time, the first slant surface 201*ax* is moved along the second slant surface 202*ax* again, so that the keycap 201 is returned to the original position as shown in FIG. 3.

From the above descriptions, while the keycap 201 is depressed, the sliding element 202 is moved to control whether the light beam can be outputted from the keycap 201 or not. Consequently, the illuminating efficacy is selectively enabled or disabled without the need of manually turning on or turning off the light-emitting element of the backlight module 23.

Figure 5:
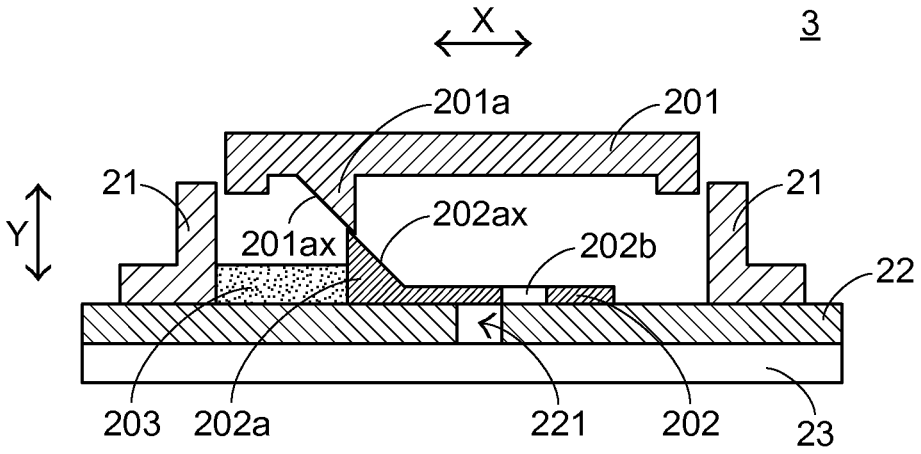
FIG. 5 is a schematic cross-sectional view illustrating the keyboard in a first operating state according to a second embodiment of the present invention.
Figure 6:
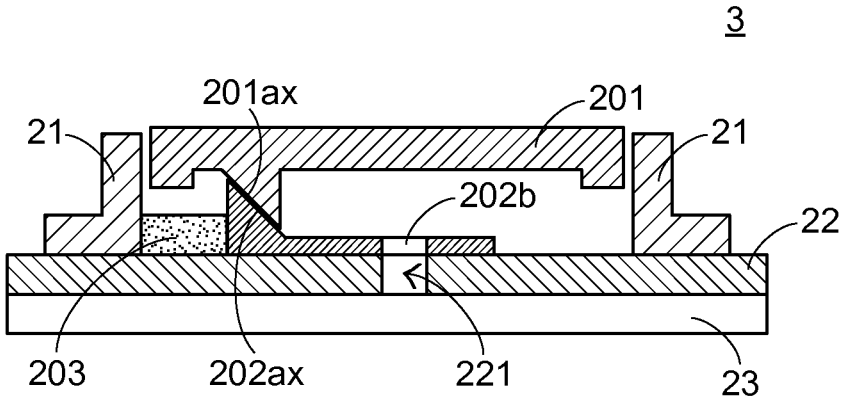
FIG. 6 is a schematic cross-sectional view illustrating the keyboard in a second operating state according to the second embodiment of the present invention.

The present invention further provides a keyboard 3 according to a second embodiment of the present invention. Please refer to FIGS. 5 and 6. FIG. 5 is a schematic cross-sectional view illustrating the keyboard in a first operating state according to the second embodiment of the present invention. FIG. 6 is a schematic cross-sectional view illustrating the keyboard in a second operating state according to the second embodiment of the present invention.

In comparison with the first embodiment, when the keycap 201 is not depressed (i.e. in the first operating state as shown in FIG. 5), the first light-transmissible zone 202*b* is not overlapped with the corresponding perforation 221 of the base plate 22. Under this circumstance, the portion of the light beam emitted by the backlight module 23 and projected upward through the perforation 221 of the base plate 22 will be blocked by the sliding element 202. Meanwhile, the light beam cannot be outputted from the keycap 201, so that the illuminating efficacy is not achieved.

On the other hand, when any keycap 201 is depressed and moved toward the base plate 22 in the vertical direction (i.e. in the second operating state as shown in FIG. 6), the first light-transmissible zone 202*b* is overlapped with the corresponding perforation 221. Under this circumstance, a portion of a light beam emitted by the backlight module 23 is projected upward through the perforation 221 of the base plate 22 and the first light-transmissible zone 202*b* and then outputted from the keycap 201. Consequently, the illuminating efficacy is achieved.

Figure 7:
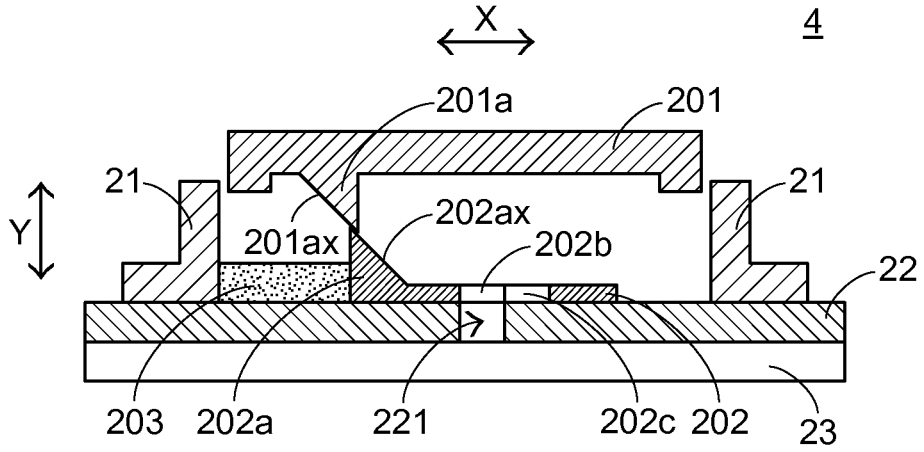
FIG. 7 is a schematic cross-sectional view illustrating the keyboard in a first operating state according to a third embodiment of the present invention.
Figure 8:
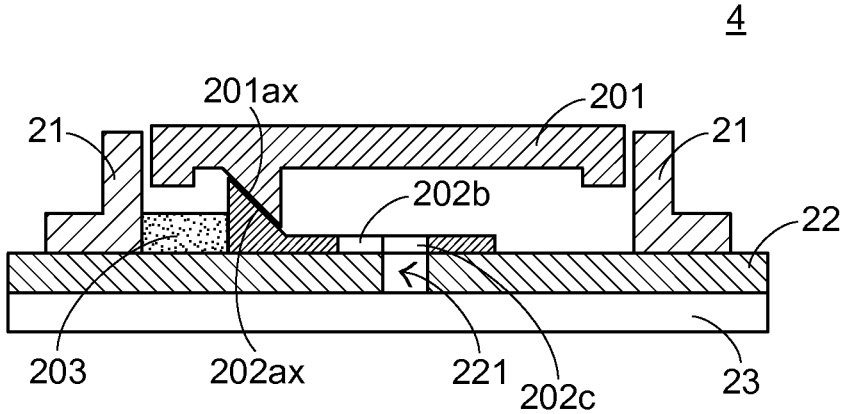
FIG. 8 is a schematic cross-sectional view illustrating the keyboard in a second operating state according to the third embodiment of the present invention.

The present invention further provides a keyboard 4 according to a third embodiment of the present invention. Please refer to FIGS. 7 and 8. FIG. 7 is a schematic cross-sectional view illustrating the keyboard in a first operating state according to the third embodiment of the present invention. FIG. 8 is a schematic cross-sectional view illustrating the keyboard in a second operating state according to the third embodiment of the present invention.

In comparison with the first embodiment, the sliding element 202 of this embodiment further comprises a second light-transmissible zone 202*c*. The first light-transmissible zone 202*b* and the second light-transmissible zone 202*c* contain different color light-transmissible materials. When the keycap 201 is not depressed (i.e. in the first operating state as shown in FIG. 7), the first light-transmissible zone 202*b* is overlapped with the corresponding perforation 221 of the base plate 22. Under this circumstance, a portion of a light beam emitted by the backlight module 23 is projected upward through the perforation 221 of the base plate 22 and the first light-transmissible zone 202*b* and then outputted from the keycap 201. Consequently, the illuminating efficacy corresponding to a first color is achieved.

On the other hand, when any keycap 201 is depressed and moved toward the base plate 22 in the vertical direction (i.e. in the second operating state as shown in FIG. 8), the second light-transmissible zone 202*c* is overlapped with the corresponding perforation 221. Under this circumstance, the portion of the light beam emitted by the backlight module 23 is projected upward through the perforation 221 of the base plate 22 and the second light-transmissible zone 202*c* and then outputted from the keycap 201. Consequently, the illuminating efficacy corresponding to a second color is achieved.

From the above descriptions, according to the number of the light-transmissible zones of the sliding element 202 and the colors of the light-transmissible materials contained in the sliding element 202, the color of the light beam outputted from the keycap 201 is correspondingly adjusted. Under this circumstance, it is not necessary to change the color of the light beam emitted by the light source.

Figure 9:
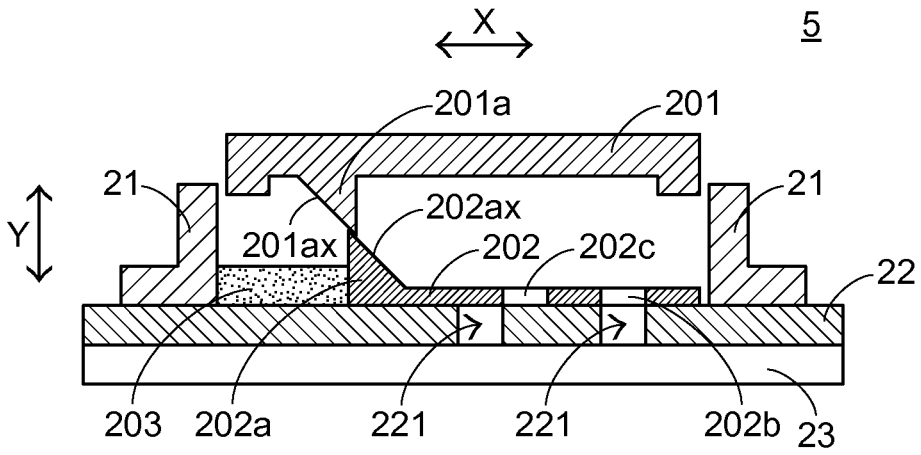
FIG. 9 is a schematic cross-sectional view illustrating the keyboard in a first operating state according to a fourth embodiment of the present invention.

The present invention further provides a keyboard 5 according to a fourth embodiment of the present invention. FIG. 9 is a schematic cross-sectional view illustrating the keyboard in a first operating state according to the fourth embodiment of the present invention.

In comparison with the third embodiment, the base plate 22 comprises two perforations 221 corresponding to each sliding element 202. When the keycap 201 is not depressed (i.e. in the first operating state as shown in FIG. 9), the first light-transmissible zone 202*b* is overlapped with one perforation 221. Under this circumstance, a portion of a light beam emitted by the backlight module 23 is projected upward through the perforation 221 of the base plate 22 and the first light-transmissible zone 202*b* and then outputted from the keycap 201. Consequently, the illuminating efficacy corresponding to a first color is achieved.

On the other hand, when any keycap 201 is depressed and moved toward the base plate 22 in the vertical direction, the second light-transmissible zone 202*c* is overlapped with the other perforation 221. Under this circumstance, the portion of the light beam emitted by the backlight module 23 is projected upward through the perforation 221 of the base plate 22 and the second light-transmissible zone 202*c* and then outputted from the keycap 201. Consequently, the illuminating efficacy corresponding to a second color is achieved.

It is noted that numerous modifications and alterations of the above embodiments may be made while retaining the teachings of the invention. For example, in some variant examples, each keycap 201 may comprise plural first protrusion parts 201*a* with corresponding first slant surfaces 201*ax*, and each sliding element 202 may comprise plural second protrusion parts 202*a* with corresponding second slant surfaces 202*ax*. Moreover, each sliding element 202 may comprise plural first light-transmissible zones 202*b* and/or plural second light-transmissible zones 202*c*. The variant examples are not restricted to the above examples.

Figure 10:
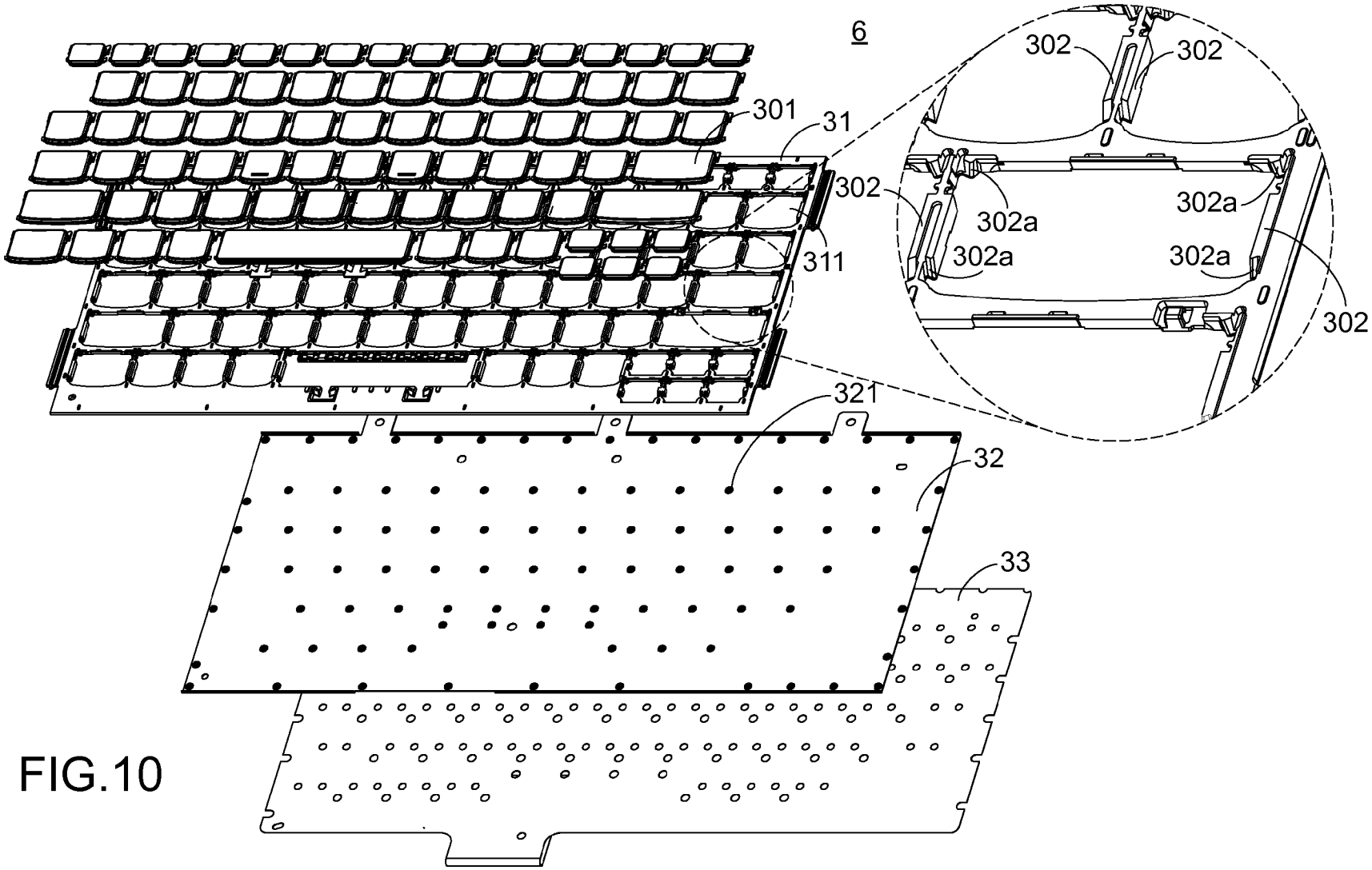
FIG. 10 is a schematic exploded view illustrating a keyboard according to a fifth embodiment of the present invention.
Figure 11:
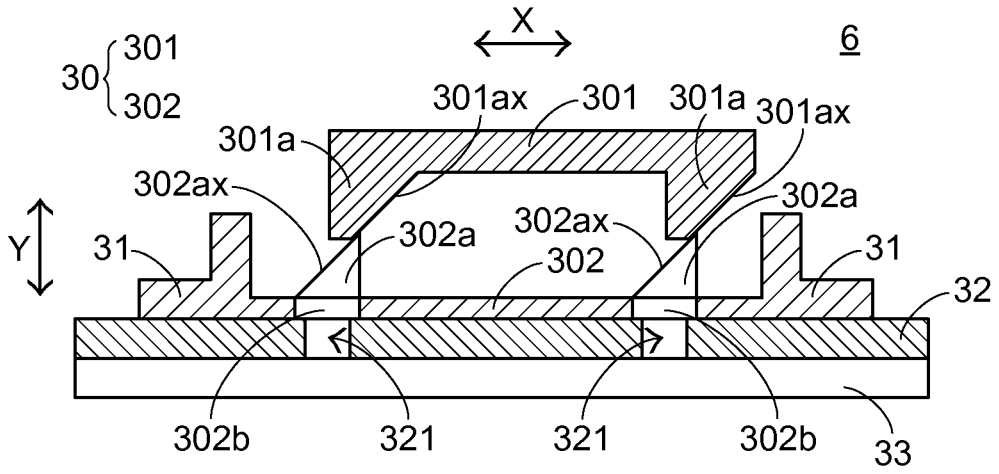
FIG. 11 is a schematic cross-sectional view illustrating the keyboard in a first operating state according to the fifth embodiment of the present invention.
Figure 12:
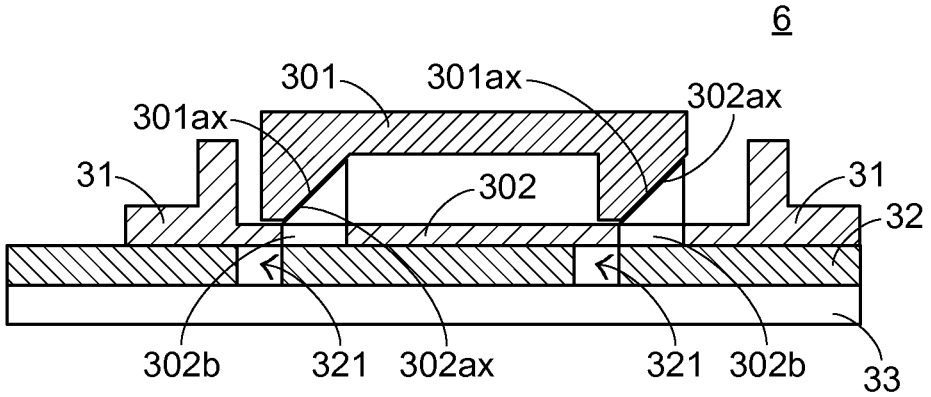
FIG. 12 is a schematic cross-sectional view illustrating the keyboard in a second operating state according to the fifth embodiment of the present invention.

The present invention further provides a keyboard 6 according to a fifth embodiment of the present invention. Please refer to FIGS. 10~12. FIG. 10 is a schematic exploded view illustrating a keyboard according to the fifth embodiment of the present invention. FIG. 11 is a schematic cross-sectional view illustrating the keyboard in a first operating state according to the fifth embodiment of the present invention. FIG. 12 is a schematic cross-sectional view illustrating the keyboard in a second operating state according to the fifth embodiment of the present invention.

The components of the keyboard 6 according to the fifth embodiment of the present invention will be illustrated as follows. The keyboard 6 comprises plural keys 30, a frame 31, a base plate 32 and a backlight module 33. Each key 30 comprises a keycap 301 and a sliding element 302.

In comparison with the first embodiment, the plural sliding elements 302 of the keyboard 6 of this embodiment are integrally formed with the frame 31. In particular, the frame 31 comprises plural openings 311. Each opening 311 is aligned with the corresponding key 30. The size of the opening 311 is smaller than the size of the keycap 301. The sidewalls of the openings 311 are defined by the plural sliding elements 302. Consequently, the frame 31 and the plural sliding elements 302 may be synchronously moved relative to the base plate 32 in a horizontal direction, which is indicated by a double-headed arrow X (see FIG. 11). Under this circumstance, the base plate 32 is not necessarily equipped with plural guiding grooves corresponding to the plural sliding elements 302. Moreover, the plural keycaps 301 are disposed over the corresponding sliding elements 302 and connected with the base plate 32. That is, the plural keycaps 301 are not connected with the frame 31.

In the above embodiments from the first embodiment to the fourth embodiment, when the any keycap 201 is depressed and moved toward the base plate 22 in the vertical direction, only the illuminating efficacy corresponding to the depressed keycap 201 is achieved or the outputted light color corresponding to the depressed keycap 201 is changed. In this embodiment, when a single keycap 301 is depressed and moved toward the base plate 32 in the vertical direction (e.g. the double-headed arrow Y as shown in FIG. 11), the frame 301 and other sliding elements 302 are moved relative to the base plate 32 in the horizontal direction according to the relation motion of the keycap 301 and the corresponding sliding element 302. Consequently, the illuminating efficacy of all keycaps 301 will be achieved or the outputted light color of all keycaps 301 will be changed.

Please refer to FIG. 11 again. Each keycap 301 comprises two first protrusion parts 301*a*. Each first protrusion part 301*a* has a first slant surface 301*ax*. Moreover, each sliding element 302 comprises a second protrusion part 302*a*. Each second protrusion part 302*a* has a second slant surface 302*ax*. The first slant surface 301*ax* and the corresponding second slant surface 302*ax* are in parallel with each other and contacted with each other.

The illuminating principles of the keyboard 6 of this embodiment will be illustrated as follows. As shown in the drawings, the base plate 22 further comprises plural perforations 321 corresponding to the plural sliding elements 302. Each sliding element 302 further comprises two first light-transmissible zones 302*b*. When the keycap 301 is not depressed (i.e. in the first operating state as shown in FIG. 11), the two first light-transmissible zones 302*b* are overlapped with the two corresponding perforations 321, respectively. Under this circumstance, a portion of a light beam emitted by the backlight module 33 is projected upward through the two perforations 321 of the base plate 32 and the two first light-transmissible zones 302*b* and then outputted from the keycap 301. Consequently, the illuminating efficacy is achieved.

When any keycap 301 is depressed (i.e. in the second operating state as shown in FIG. 12), the keycap 301 is moved toward the base plate 32 in the vertical direction. Consequently, the two first slant surfaces 301*ax* are moved along the two second slant surfaces 302*ax*, respectively. As the two first slant surfaces 301*ax* are moved along the two second slant surfaces 302*ax*, the sliding element 302 and the frame 31 are moved relative to the base plate 32 in the horizontal direction. Consequently, the two first light-transmissible zones 302*b* are no longer overlapped with the two corresponding perforations 321, respectively. Under this circumstance, the portion of the light beam emitted by the backlight module 33 and projected upward through the two perforations 321 of the base plate 32 will be blocked by the sliding element 302. Meanwhile, the light beam cannot be outputted from the keycap 301, so that the illuminating efficacy is not achieved.

In this embodiment, the two second protrusion parts 302*a* are overlapped with the two first light-transmissible zones 302*b*, respectively. Consequently, the two second protrusion parts 302*a* are made of a light-transmissible material. In case that the two second protrusion parts 302*a* are not overlapped with the two first light-transmissible zones 302*b*, the two second protrusion parts 302*a* are not necessarily made of the light-transmissible material.

Figure 13:
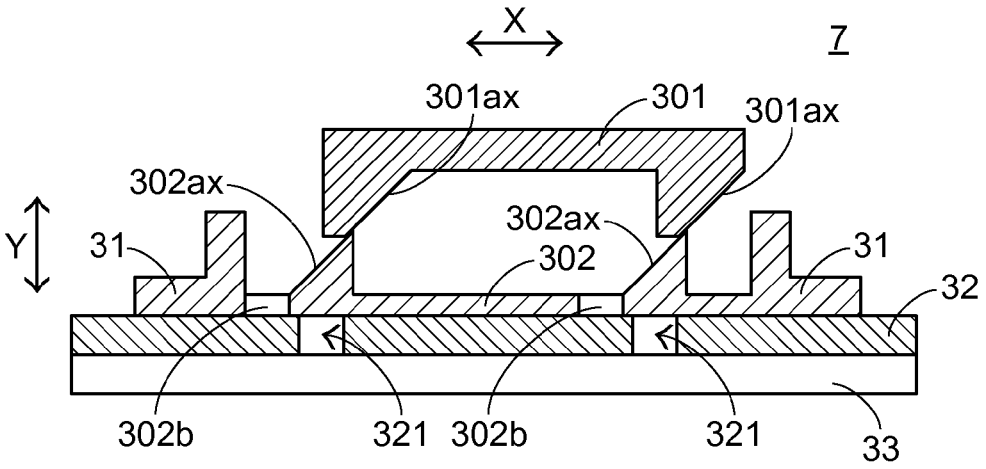
FIG. 13 is a schematic cross-sectional view illustrating the keyboard in a first operating state according to a sixth embodiment of the present invention.
Figure 14:
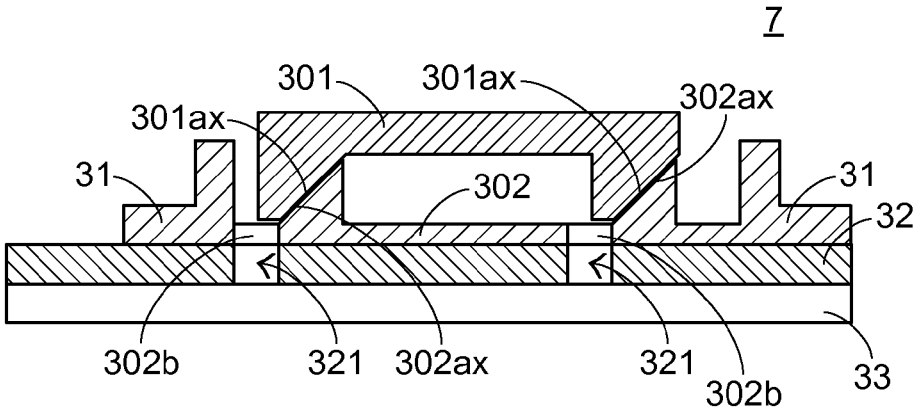
FIG. 14 is a schematic cross-sectional view illustrating the keyboard in a second operating state according to the sixth embodiment of the present invention.

The present invention further provides a keyboard 7 according to a sixth embodiment of the present invention. Please refer to FIGS. 13 and 14. FIG. 13 is a schematic cross-sectional view illustrating the keyboard in a first operating state according to the sixth embodiment of the present invention. FIG. 14 is a schematic cross-sectional view illustrating the keyboard in a second operating state according to the sixth embodiment of the present invention.

In comparison with the fifth embodiment, when the keycap 301 is not depressed (i.e. in the first operating state as shown in FIG. 13), the two first light-transmissible zones 302*b* are not overlapped with the two perforations 321 of the base plate 32, respectively. Under this circumstance, the portion of the light beam emitted by the backlight module 33 and projected upward through the two perforations 321 of the base plate 32 will be blocked by the sliding element 302. Meanwhile, the light beam cannot be outputted from the keycap 301, so that the illuminating efficacy is not achieved.

On the other hand, when any keycap 301 is depressed and moved toward the base plate 32 in the vertical direction (i.e. in the second operating state as shown in FIG. 14), the two first light-transmissible zones 302*b* are overlapped with the two perforations 321, respectively. Under this circumstance, a portion of a light beam emitted by the backlight module 33 is projected upward through the two perforations 321 of the base plate 32 and the two first light-transmissible zones 302*b* and then outputted from the keycap 301. Consequently, the illuminating efficacy is achieved.

Figure 15:
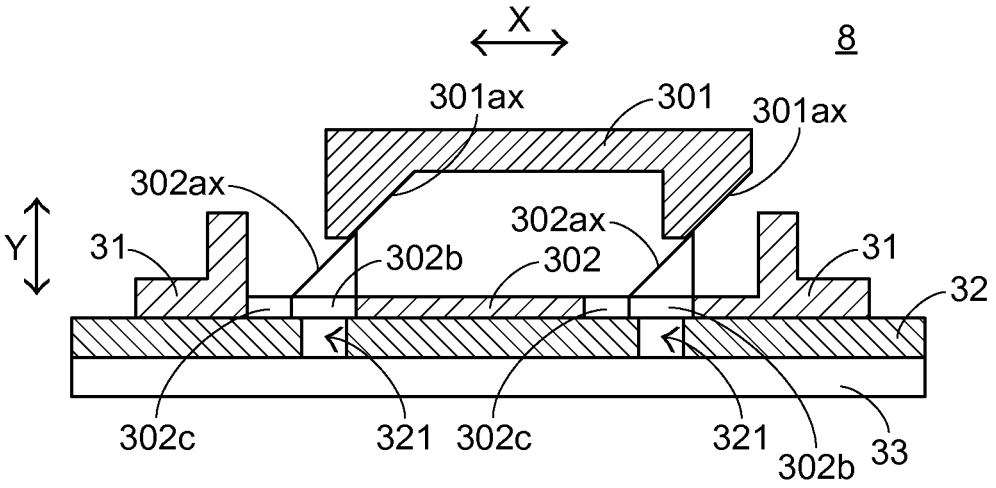
FIG. 15 is a schematic cross-sectional view illustrating the keyboard in a first operating state according to a seventh embodiment of the present invention.
Figure 16:
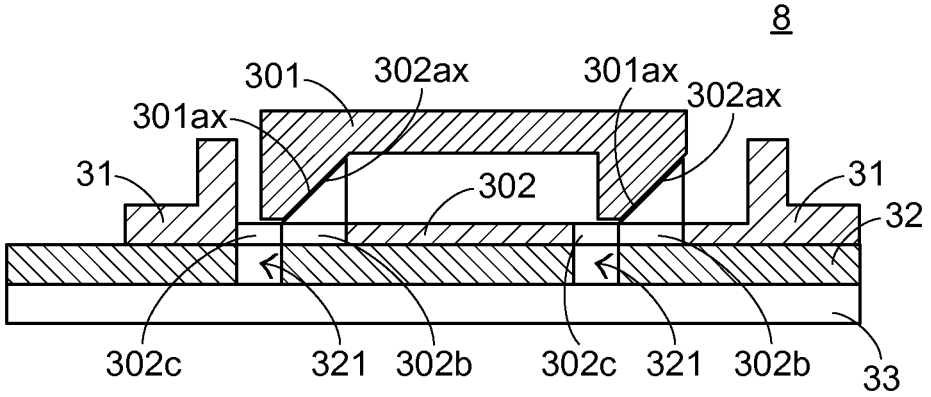
FIG. 16 is a schematic cross-sectional view illustrating the keyboard in a second operating state according to the seventh embodiment of the present invention.

The present invention further provides a keyboard 8 according to a seventh embodiment of the present invention. Please refer to FIGS. 15 and 16. FIG. 15 is a schematic cross-sectional view illustrating the keyboard in a first operating state according to the seventh embodiment of the present invention. FIG. 16 is a schematic cross-sectional view illustrating the keyboard in a second operating state according to the seventh embodiment of the present invention.

In comparison with the fifth embodiment, the sliding element 302 of this embodiment further comprises two second light-transmissible zones 302*c*. The first light-transmissible zone 302*b* and the second light-transmissible zone 302*c* contain different color light-transmissible materials.

When the keycap 301 is not depressed (i.e. in the first operating state as shown in FIG. 15), the two first light-transmissible zones 302*b* are overlapped with the two perforations 321 of the base plate 32, respectively. Under this circumstance, a portion of a light beam emitted by the backlight module 33 is projected upward through the two perforations 321 of the base plate 32 and the two first light-transmissible zones 302*b* and then outputted from the keycap 301. Consequently, the illuminating efficacy corresponding to a first color is achieved.

On the other hand, when any keycap 301 is depressed and moved toward the base plate 32 in the vertical direction (i.e. in the second operating state as shown in FIG. 16), the two second light-transmissible zones 302*c* are overlapped with the two perforations 321, respectively. Under this circumstance, the portion of the light beam emitted by the backlight module 33 is projected upward through the two perforations 321 of the base plate 32 and the two second light-transmissible zones 302*c* and then outputted from the keycap 301. Consequently, the illuminating efficacy corresponding to a second color is achieved.

It is noted that numerous modifications and alterations of the fifth, sixth and seventh embodiments may be made while retaining the teachings of the invention. For example, in some variant examples, each keycap 301 may comprise a single first protrusion part 301*a* with the first slant surface 301*ax*, and each sliding element 302 may comprise a single second protrusion part 302*a* with the second slant surface 302*ax*. Moreover, each sliding element 302 may comprise a single first light-transmissible zone 302*b* and/or a single second light-transmissible zone 302*c*. The variant examples are not restricted to the above examples.

Figure 17:
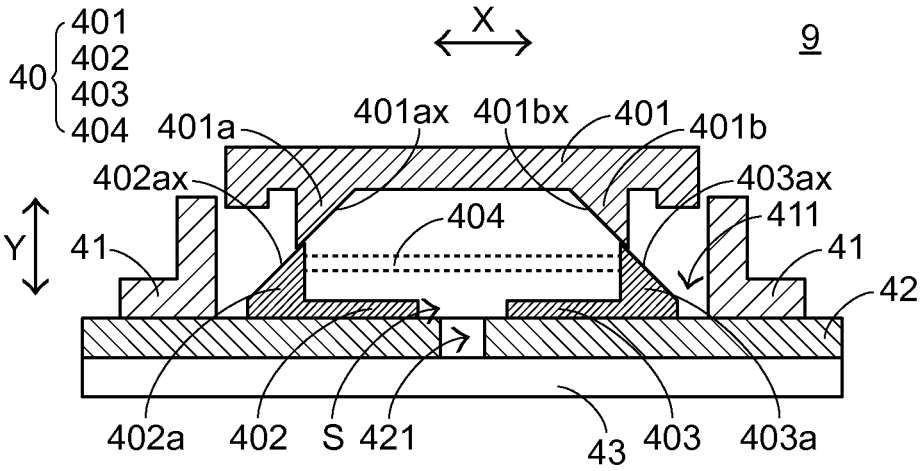
FIG. 17 is a schematic cross-sectional view illustrating the keyboard in a first operating state according to an eighth embodiment of the present invention.
Figure 18:
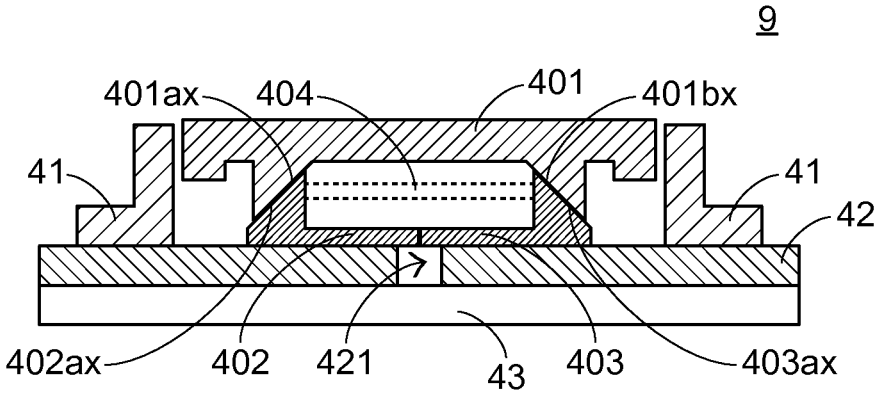
FIG. 18 is a schematic cross-sectional view illustrating the keyboard in a second operating state according to the eighth embodiment of the present invention.

The present invention further provides a keyboard 9 according to an eighth embodiment of the present invention. Please refer to FIGS. 17 and 18. FIG. 17 is a schematic cross-sectional view illustrating the keyboard in a first operating state according to the eighth embodiment of the present invention. FIG. 18 is a schematic cross-sectional view illustrating the keyboard in a second operating state according to the eighth embodiment of the present invention.

The components of the keyboard 9 according to the eighth embodiment of the present invention will be illustrated as follows. The keyboard 9 comprises plural keys 40, a frame 41, a base plate 42 and a backlight module 43. Each key 40 comprises a keycap 401, a first sliding element 402, a second sliding element 403 and an elastic element 404.

The sequence of assembling the keyboard 9 will be illustrated as follows. Firstly, the base plate 42 is disposed on the backlight module 43, and the frame 41 is disposed on the base plate 42. The frame 41 comprises plural openings 411. Each opening 411 is aligned with the corresponding key 40. The first sliding element 402 and the second sliding element 403 of each key 40 are disposed within the corresponding opening 411. The elastic element 404 is arranged between the first sliding element 402 and the second sliding element 403. Moreover, the base plate 42 may comprise plural guiding grooves (not shown) corresponding to the plural first sliding elements 402 and the plural second sliding elements 403. Consequently, the plural first sliding elements 402 and the plural second sliding elements 403 can be moved within specified regions and relative to the base plate 42 in a horizontal direction, which is indicated by a double-headed arrow X (see FIG. 17).

The plural keycaps 401 are disposed over the plural first sliding elements 402 and the plural second sliding elements 403 of the corresponding keys 40. Moreover, the plural keycaps 401 are connected with the frame 41 around the openings 411 or connected with the base plate 411 underlying the openings 411. Consequently, the keycaps 401 are only able to be moved relative to the base plate 42 in a vertical direction, which is indicated by a double-headed arrow Y (see FIG. 17). That is, the keycaps 401 cannot be moved relative to the base plate 42 in the horizontal direction.

Please refer to FIG. 17 again. Each keycap 401 comprises a first protrusion part 401*a* and a second protrusion part 401*b*. The first protrusion part 401*a* has an externally-inclined first slant surface 401*ax*. The second protrusion part 401*b* has an externally-inclined second slant surface 401*bx*. Each first sliding element 402 comprises a third protrusion part 402*a*, wherein the third protrusion part 402*a* has an externally-inclined third protrusion part 402*ax*. Each second sliding element 403 comprises a fourth protrusion part 403*a*, wherein the fourth protrusion part 403*a* has an externally-inclined fourth protrusion part 403*ax*. Moreover, the first slant surface 401*ax* and the second slant surface 401*bx* are inclined toward different directions, and the third protrusion part 402*ax* and the fourth protrusion part 403*ax* are inclined toward different directions. Moreover, the first slant surface 401*ax* and the third protrusion part 402*ax* are in parallel with each other and contacted with each other, and the second slant surface 401*bx* and the fourth protrusion part 403*a* are in parallel with each other and contacted with each other.

The illuminating principles of the keyboard 9 of this embodiment will be illustrated as follows. As shown in FIGS. 17 and 18, the base plate 42 further comprises plural perforations 421 corresponding to the plural keys 40, respectively. When the keycap 401 is not depressed (i.e. in the first operating state as shown in FIG. 17), the elastic element 404 between the first sliding element 402 and the second sliding element 403 is in a released state. Consequently, the first sliding element 402 and the second sliding element 403 are separated from each other by a specified distance, and a notch S is formed between the first sliding element 402 and the second sliding element 403. The notch S is overlapped with the perforation 421 of the base plate 42. Under this circumstance, a portion of a light beam emitted by the backlight module 43 is projected upward through the perforation 421 of the base plate 42 and the notch S and then outputted from the keycap 401. Consequently, the illuminating efficacy is achieved.

When any keycap 401 is depressed (i.e. in the second operating state as shown in FIG. 18), the keycap 401 is moved toward the base plate 42 in the vertical direction. Consequently, the first slant surface 401*ax* is moved along the third protrusion part 402*ax*, and the second slant surface 401*bx* is moved along the fourth protrusion part 403*a*. As the first slant surface 401*ax* is moved along the third protrusion part 402*ax*, the first sliding element 402 is moved relative to the base plate 42 in a horizontal direction. As the second slant surface 401*bx* is moved along the fourth protrusion part 403*a*, the second sliding element 403 is moved relative to the base plate 42 in the horizontal direction. Since the first slant surface 401*ax* and the second slant surface 401*bx* are inclined externally in opposite directions and the third protrusion part 402*ax* and the fourth protrusion part 403*a* are inclined externally in opposite directions, the first sliding element 402 and the second sliding element 403 are moved internally toward each other in opposite directions. When the first sliding element 402 and the second sliding element 403 are contacted with each other, the portion of the light beam emitted by the backlight module 43 and projected upward through the perforation 421 of the base plate 42 will be blocked by the first sliding element 402 and the second sliding element 403. Meanwhile, the light beam cannot be outputted from the keycap 401, so that the illuminating efficacy is not achieved.

Moreover, while any keycap 401 is depressed, the first sliding element 402 and the second sliding element 403 are moved toward each other so as to compress the elastic element 404. Consequently, the elastic element 404 is in a compressed state (see FIG. 18). When the keycap 401 is no longer depressed, the elastic element 404 is restored to a released state. Consequently, the first sliding element 402 and the second sliding element 403 are moved to the original positions as shown in FIG. 17. At the same time, the first slant surface 401*ax* is moved along the third protrusion part 402*ax* again, and the second slant surface 401*bx* is moved along the fourth protrusion part 403*a* again. Consequently, the keycap 401 is returned to the original position as shown in FIG. 17.

Figure 19:
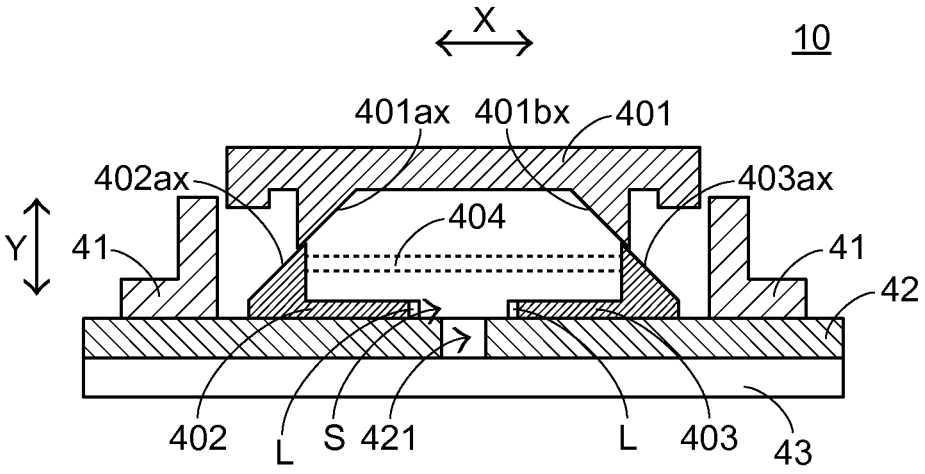
FIG. 19 is a schematic cross-sectional view illustrating the keyboard in a first operating state according to a ninth embodiment of the present invention.
Figure 20:
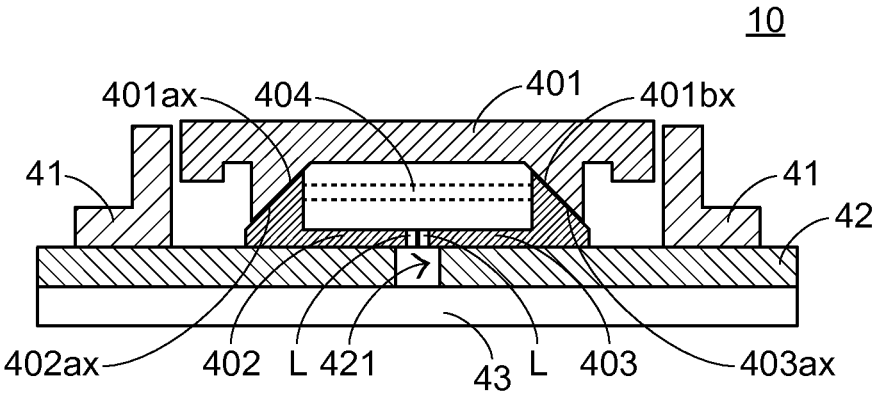
FIG. 20 is a schematic cross-sectional view illustrating the keyboard in a second operating state according to the ninth embodiment of the present invention.

The present invention further provides a keyboard 10 according to a ninth embodiment of the present invention. Please refer to FIGS. 19 and 20. FIG. 19 is a schematic cross-sectional view illustrating the keyboard in a first operating state according to the ninth embodiment of the present invention. FIG. 20 is a schematic cross-sectional view illustrating the keyboard in a second operating state according to the ninth embodiment of the present invention.

In comparison with the eighth embodiment, each of the first sliding element 402 and the second sliding element 403 of this embodiment further comprises a light-transmissible zone L. The light-transmissible zone L is made of a non-transparent light-transmissible material. When any keycap 401 is moved toward the base plate 42 in the vertical direction and the first sliding element 402 and the second sliding element 403 are contacted with each other (i.e. in the second operating state as shown in FIG. 20), the light-transmissible zone L is overlapped with the perforation 421 of the base plate 42. Under this circumstance, a portion of a light beam emitted by the backlight module 43 is projected upward through the perforation 421 of the base plate 42 and the light-transmissible zone L and then outputted from the keycap 401. Consequently, the illuminating efficacy corresponding to another color different from the original color is achieved.

Figure 21:
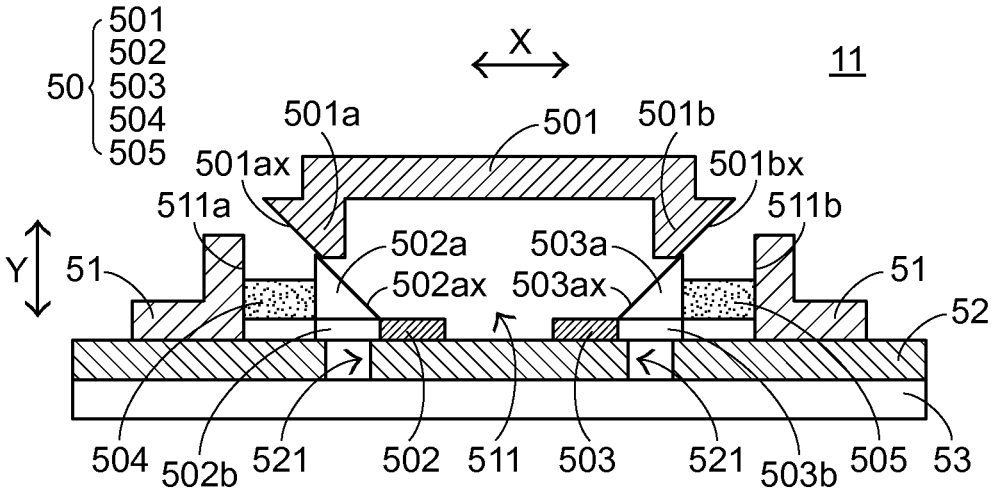
FIG. 21 is a schematic cross-sectional view illustrating the keyboard in a first operating state according to a tenth embodiment of the present invention.
Figure 22:
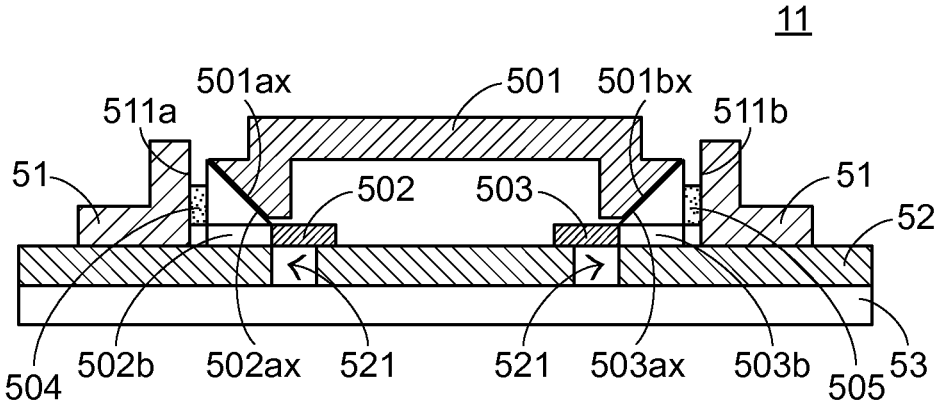
FIG. 22 is a schematic cross-sectional view illustrating the keyboard in a second operating state according to the tenth embodiment of the present invention.

The present invention further provides a keyboard 11 according to a tenth embodiment of the present invention. Please refer to FIGS. 21 and 22. FIG. 21 is a schematic cross-sectional view illustrating the keyboard in a first operating state according to the tenth embodiment of the present invention. FIG. 22 is a schematic cross-sectional view illustrating the keyboard in a second operating state according to the tenth embodiment of the present invention.

The components of the keyboard 11 according to the tenth embodiment of the present invention will be illustrated as follows. The keyboard 11 comprises plural keys 50, a frame 51, a base plate 52 and a backlight module 53. Each key 50 comprises a keycap 501, a first sliding element 502, a second sliding element 503, a first elastic element 504 and a second elastic element 505.

In comparison with the eighth embodiment, the first protrusion part 501*a* of each keycap 501 has an internally-inclined first slant surface 501*ax*, the second protrusion part 501*b* has an internally-inclined second slant surface 501*bx*, the third protrusion part 502*a* of each first sliding element 502 has an internally-inclined third protrusion part 502*ax*, and the fourth protrusion part 503*a* of each second sliding element 503 has an internally-inclined fourth protrusion part 503*ax*.

Moreover, the keyboard 11 further comprises the first elastic element 504 and the second elastic element 505. The first elastic element 504 is arranged between the first sliding element 502 and a first sidewall 511*a* of the opening 511 of the frame 51. The second elastic element 505 is arranged between the second sliding element 503 and a second sidewall 511*b* of the opening 511 of the frame 51. Moreover, the first sidewall 511*a* and the second sidewall 511*b* are in parallel with each other.

As shown in FIGS. 21 and 22, each key 50 is aligned with two perforations 521 of the base plate 521. The two perforations 521 correspond to the first sliding element 502 and the second sliding element 503, respectively. Each first sliding element 502 further comprises a first light-transmissible zone 502*b*. Each second sliding element 503 further comprises a second light-transmissible zone 503*b*.

When the keycap 501 is not depressed (i.e. in the first operating state as shown in FIG. 21), the first light-transmissible zone 502*b* and the second light-transmissible zone 503*b* are overlapped with the two perforations 521, respectively. Under this circumstance, a portion of a light beam emitted by the backlight module 53 is projected upward through the two perforations 521 of the base plate 52, the first light-transmissible zone 502*b* and the second light-transmissible zone 503*b* and then outputted from the keycap 501. Consequently, the illuminating efficacy is achieved.

When any keycap 501 is depressed (i.e. in the second operating state as shown in FIG. 22), the keycap 501 is moved toward the base plate 52 in the vertical direction. Consequently, the first slant surface 501*ax* is moved along the third protrusion part 502*ax*, and the second slant surface 501*bx* is moved along the fourth protrusion part 503*a*. As the first slant surface 501*ax* is moved along the third protrusion part 502*ax*, the first sliding element 502 is moved relative to the base plate 52 in a horizontal direction. As the second slant surface 501*bx* is moved along the fourth protrusion part 503*a*, the second sliding element 503 is moved relative to the base plate 52 in the horizontal direction. Since the first slant surface 501*ax* and the second slant surface 501*bx* are inclined internally in opposite directions and the third protrusion part 502*ax* and the fourth protrusion part 503*a* are inclined internally in opposite directions, the first sliding element 502 and the second sliding element 503 are moved externally away from each other in opposite directions. Consequently, the first light-transmissible zone 502*b* and the second light-transmissible zone 503*b* are no longer overlapped with the two perforations 521, respectively. Under this circumstance, the portion of the light beam emitted by the backlight module 53 and projected upward through the perforations 521 of the base plate 52 will be blocked by the first sliding element 502 and the second sliding element 503. Meanwhile, the light beam cannot be outputted from the keycap 501, so that the illuminating efficacy is not achieved.

Moreover, while any keycap 501 is depressed, the first sliding element 502 and the second sliding element 503 are moved toward the first sidewall 511*a* and the second sidewall 511*b* to compress the first elastic element 504 and the second elastic element 505, respectively. Consequently, the first elastic element 504 and the second elastic element 505 are in a compressed state (see FIG. 22). When the keycap 501 is no longer depressed, the first elastic element 504 and the second elastic element 505 are restored to a released state. Consequently, the first sliding element 502 and the second sliding element 503 are moved to the original positions as shown in FIG. 21. At the same time, the first slant surface 501*ax* is moved along the third protrusion part 502*ax* again, and the second slant surface 501*bx* is moved along the fourth protrusion part 503*a* again. Consequently, the keycap 501 is returned to the original position as shown in FIG. 21.

Figure 23:
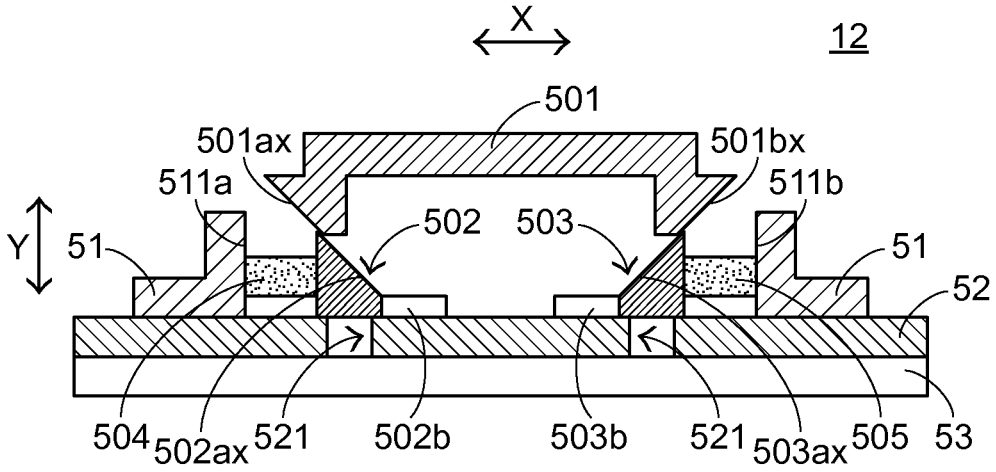
FIG. 23 is a schematic cross-sectional view illustrating the keyboard in a first operating state according to an eleventh embodiment of the present invention.
Figure 24:
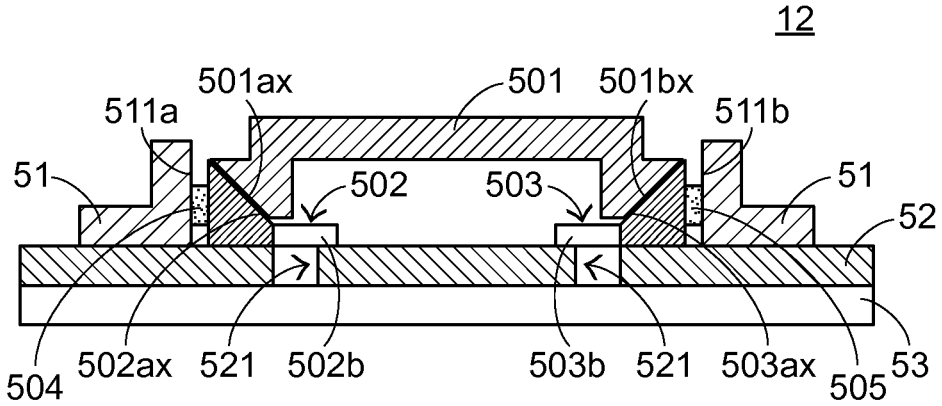
FIG. 24 is a schematic cross-sectional view illustrating the keyboard in a second operating state according to the eleventh embodiment of the present invention.

The present invention further provides a keyboard 12 according to an eleventh embodiment of the present invention. Please refer to FIGS. 23 and 24. FIG. 23 is a schematic cross-sectional view illustrating the keyboard in a first operating state according to the eleventh embodiment of the present invention. FIG. 24 is a schematic cross-sectional view illustrating the keyboard in a second operating state according to the eleventh embodiment of the present invention.

In comparison with the tenth embodiment, when the keycap 501 is not depressed (i.e. in the first operating state as shown in FIG. 23), the first light-transmissible zone 502*b* and the second light-transmissible zone 503*b* are not overlapped with the two perforations 521, respectively. Under this circumstance, the portion of the light beam emitted by the backlight module 53 and projected upward through the perforations 521 of the base plate 52 will be blocked by the first sliding element 502 and the second sliding element 503. Meanwhile, the light beam cannot be outputted from the keycap 501, so that the illuminating efficacy is not achieved.

When any keycap 501 is depressed (i.e. in the second operating state as shown in FIG. 24), the first sliding element 502 and the second sliding element 503 are moved externally away from each other in opposite directions. Consequently, the first light-transmissible zone 502*b* and the second light-transmissible zone 503*b* are overlapped with the two perforations 521, respectively. Under this circumstance, a portion of a light beam emitted by the backlight module 53 is projected upward through the two perforations 521 of the base plate 52, the first light-transmissible zone 502*b* and the second light-transmissible zone 503*b* and then outputted from the keycap 501. Consequently, the illuminating efficacy is achieved.

Figure 25:
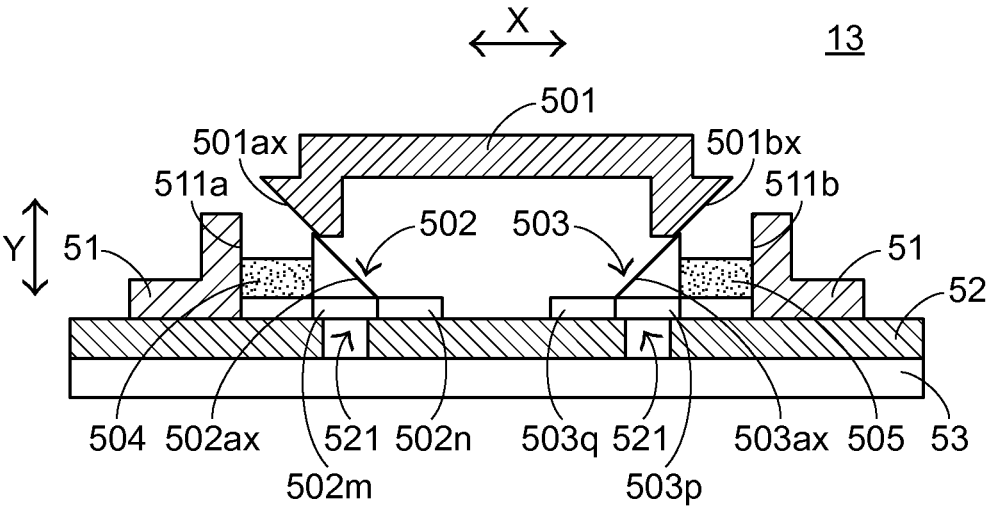
FIG. 25 is a schematic cross-sectional view illustrating the keyboard in a first operating state according to a twelfth embodiment of the present invention.
Figure 26:
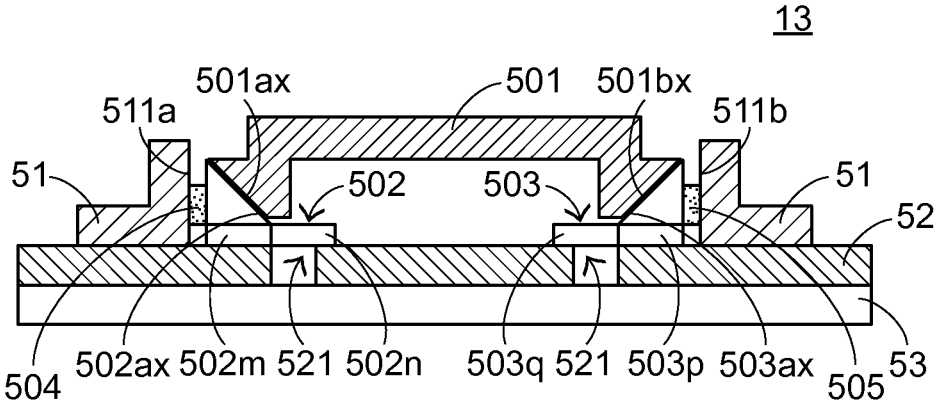
FIG. 26 is a schematic cross-sectional view illustrating the keyboard in a second operating state according to the twelfth embodiment of the present invention.

The present invention further provides a keyboard 13 according to a twelfth embodiment of the present invention. Please refer to FIGS. 25 and 26. FIG. 25 is a schematic cross-sectional view illustrating the keyboard in a first operating state according to the twelfth embodiment of the present invention. FIG. 26 is a schematic cross-sectional view illustrating the keyboard in a second operating state according to the twelfth embodiment of the present invention.

In comparison with the tenth embodiment, the first sliding element 502 of this embodiment comprises a first light-transmissible zone 502*m* and a second light-transmissible zone 502*n*, and the second sliding element 503 of this embodiment comprises a third light-transmissible zone 503*p* and a fourth light-transmissible zone 503*q*. The first light-transmissible zone 502*m* and the second light-transmissible zone 502*n* contain different color light-transmissible materials. The third light-transmissible zone 503*p* and the fourth light-transmissible zone 503*q* contain different color light-transmissible materials.

When the keycap 501 is not depressed (i.e. in the first operating state as shown in FIG. 25), the first light-transmissible zone 502*m* and the third light-transmissible zone 503*p* are overlapped with the two perforations 521 of the base plate 52, respectively. Under this circumstance, a portion of a light beam emitted by the backlight module 53 is projected upward through the two perforations 521 of the base plate 52, the first light-transmissible zone 502*m* and the third light-transmissible zone 503*p* and then outputted from the keycap 501. Consequently, the illuminating efficacy corresponding to a first color is achieved.

When any keycap 501 is depressed and moved toward the base plate 52 in a vertical direction (i.e. in the second operating state as shown in FIG. 26), the second light-transmissible zone 502*n* and the fourth light-transmissible zone 503*q* are overlapped with the two perforations 521, respectively. Under this circumstance, a portion of a light beam emitted by the backlight module 53 is projected upward through the two perforations 521 of the base plate 52, the second light-transmissible zone 502*n* and the fourth light-transmissible zone 503*q* and then outputted from the keycap 501. Consequently, the illuminating efficacy corresponding to a second color is achieved.

From the above descriptions, the present invention provides the illuminated keyboard. While the keycap is depressed, the sliding element is moved to control whether the light beam can be outputted from the keycap or not. Consequently, the illuminating efficacy is selectively enabled or disabled without the need of manually turning on or turning off the light-emitting element of the backlight module. Moreover, according to the number of the light-transmissible zones of the sliding element and the colors of the light-transmissible materials contained in the sliding element, the color of the light beam outputted from the keycap of the illuminated keyboard is correspondingly adjusted. Consequently, the illuminated keyboard of the present invention can overcome the drawbacks of the conventional illuminated keyboard.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A keyboard, comprising:

plural keys, wherein each key comprises:

a keycap comprising at least one first protrusion part, wherein the first protrusion part has a first slant surface; and a sliding element disposed under the keycap and comprising at least one second protrusion part, wherein the second protrusion part has a second slant surface, and the first slant surface and the second slant surface are in parallel with each other;

a base plate disposed under the plural sliding elements of the plural keys and limiting positions of the plural sliding elements, wherein the base plate comprises plural perforations corresponding to the plural sliding elements; and a backlight module disposed under the base plate and emitting a light beam to the base plate, wherein when one of the plural keycaps is depressed and moved toward the base plate, the first slant surface is moved along the second slant surface to move the sliding element to be moved relative to the base plate in a horizontal direction, so that the light beam transmitted through the corresponding perforation of the base plate is further transmitted through the sliding element and outputted from the keycap or the light beam transmitted through the corresponding perforation of the base plate is blocked by the sliding element.

2. The illuminated keyboard according to claim 1, wherein each sliding element further comprises at least one first light-transmissible zone, wherein when the keycap is not moved toward the base plate, the first light-transmissible zone is overlapped with the corresponding perforation, so that the light beam is transmitted through the perforation and the first light-transmissible zone and outputted from the keycap, wherein when the keycap is moved toward the base plate to push the sliding element to be moved relative to the base plate in the horizontal direction, the first light-transmissible zone is not overlapped with the corresponding perforation, so that the light beam is blocked by the sliding element and not outputted from the keycap.

3. The illuminated keyboard according to claim 1, wherein each sliding element further comprises at least one first light-transmissible zone, wherein when the keycap is not moved toward the base plate, the first light-transmissible zone is not overlapped with the corresponding perforation, so that the light beam is blocked by the sliding element and not outputted from the keycap, wherein when the keycap is moved toward the base plate to push the sliding element to be moved relative to the base plate in the horizontal direction, the first light-transmissible zone is overlapped with the corresponding perforation, so that the light beam is transmitted through the perforation and the first light-transmissible zone and outputted from the keycap.

4. The illuminated keyboard according to claim 1, wherein each sliding element further comprises at least one first light-transmissible zone and at least one second light-transmissible zone, wherein when the keycap is not moved toward the base plate, the first light-transmissible zone is overlapped with the corresponding perforation, so that the light beam is transmitted through the perforation and the first light-transmissible zone and outputted from the keycap, wherein when the keycap is moved toward the base plate to push the sliding element to be moved relative to the base plate in the horizontal direction, the second light-transmissible zone is overlapped with the corresponding perforation, so that the light beam is transmitted through the perforation and the second light-transmissible zone and outputted from the keycap.

5. The illuminated keyboard according to claim 4, wherein the first light-transmissible zone and the second light-transmissible zone contain different color light-transmissible materials.

6. The illuminated keyboard according to claim 1, further comprising a frame, wherein the frame is disposed on the base plate and comprises plural openings, wherein the plural openings are respectively aligned with the plural keys, and the plural sliding elements are respectively disposed within the plural openings.

7. The illuminated keyboard according to claim 6, wherein the plural keycaps are connected with the frame or the base plate.

8. The illuminated keyboard according to claim 6, wherein each key further comprises an elastic element, wherein the elastic element is arranged between the sliding element and a sidewall of the opening, and the sliding element is restored to an original position by the elastic element.

9. The illuminated keyboard according to claim 6, wherein the plural sliding elements are integrally formed with the frame.

10. The illuminated keyboard according to claim 1, wherein the base plate further comprises plural guiding grooves corresponding to the plural sliding elements.

11. A keyboard, comprising:

plural keys, wherein each key comprises:

a keycap comprising a first protrusion part and a second protrusion part, wherein the first protrusion part has a first slant surface, and the second protrusion part has a second slant surface, wherein the second slant surface and the first slant surface are inclined in different directions;

a first sliding element disposed under the keycap and comprising a third protrusion part, wherein the third protrusion part has a third slant surface, and the third slant surface and the first slant surface are in parallel with each other; and a second sliding element disposed under the keycap and comprising a fourth protrusion part, wherein the fourth protrusion part has a fourth slant surface, the fourth slant surface and the third slant surface are inclined in different directions, and the fourth slant surface and the second slant surface are in parallel with each other;

a base plate disposed under the plural first sliding elements and the plural second sliding elements of the plural keys and limiting positions of the plural first sliding elements and the plural second sliding elements, wherein the base plate comprises plural perforations corresponding to the plural keys; and a backlight module disposed under the base plate and emitting a light beam to the base plate, wherein when one of the plural keycaps is depressed and moved toward the base plate, the first slant surface is moved along the third slant surface and the second slant surface is moved along the fourth slant surface so as to push the first sliding element and the second sliding element to be moved relative to the base plate in a horizontal direction, so that the light beam transmitted through at least one of the plural perforations of the base plate is further transmitted through the first sliding element or the second sliding element and outputted from the keycap or the light beam transmitted through at least one of the plural perforations of the base plate is blocked by the first sliding element or the second sliding element.

12. The illuminated keyboard according to claim 11, wherein each key is aligned with two perforations of the plural perforations, each first sliding element comprises a first light-transmissible zone, and each second sliding element comprises a second light-transmissible zone, wherein the two perforations correspond to the first sliding element and the second sliding element, respectively.

13. The illuminated keyboard according to claim 12, wherein when the keycap is not moved toward the base plate, the first light-transmissible zone and the second light-transmissible zone are respectively overlapped with the two perforations, so that the light beam is transmitted through the two perforations, the first light-transmissible zone and the second light-transmissible zone and outputted from the keycap, wherein when the keycap is moved toward the base plate to push the first sliding element and the second sliding element to be moved away from each other in opposite directions, the first light-transmissible zone and the second light-transmissible zone are not overlapped with the two perforations, so that the light beam is blocked by the first sliding element and the second sliding element and not outputted from the keycap.

14. The illuminated keyboard according to claim 12, wherein when the keycap is not moved toward the base plate, the first light-transmissible zone and the second light-transmissible zone are not overlapped with the two perforations, so that the light beam is blocked by the first sliding element and the second sliding element and not outputted from the keycap, wherein when the keycap is moved toward the base plate to push the first sliding element and the second sliding element to be moved away from each other in opposite directions, the first light-transmissible zone and the second light-transmissible zone are respectively overlapped with the two perforations, so that the light beam is transmitted through the two perforations, the first light-transmissible zone and the second light-transmissible zone and outputted from the keycap.

15. The illuminated keyboard according to claim 11, wherein each key is aligned with two perforations of the plural perforations, each first sliding element comprises a first light-transmissible zone and a second light-transmissible zone, and each second sliding element comprises a third light-transmissible zone and a fourth light-transmissible zone, wherein the two perforations correspond to the first sliding element and the second sliding element, respectively.

16. The illuminated keyboard according to claim 15, wherein when the keycap is not moved toward the base plate, the first light-transmissible zone and the third light-transmissible zone are respectively overlapped with the two perforations, so that the light beam is transmitted through the two perforations, the first light-transmissible zone and the third light-transmissible zone and outputted from the keycap, wherein when the keycap is moved toward the base plate to push the first sliding element and the second sliding element to be moved away from each other in opposite directions, the second light-transmissible zone and the fourth light-transmissible zone are respectively overlapped with the two perforations, so that the light beam is transmitted through the two perforations, the second light-transmissible zone and the fourth light-transmissible zone and outputted from the keycap.

17. The illuminated keyboard according to claim 15, wherein the first light-transmissible zone and the second light-transmissible zone contain different color light-transmissible materials, and the third light-transmissible zone and the fourth light-transmissible zone contain different color light-transmissible materials.

18. The illuminated keyboard according to claim 11, wherein each key is aligned with one perforation of the plural perforations, and the perforation is arranged between the first sliding element and the second sliding element, wherein when the keycap is not moved toward the base plate, the first sliding element and the second sliding element are separated from each other by a specified distance, and a notch is formed between the first sliding element and the second sliding element, so that the light beam is transmitted through the perforation and the notch and outputted from the keycap.

19. The illuminated keyboard according to claim 18, wherein while the keycap is moved toward the base plate, the first sliding element and the second sliding element are moved toward each other in opposite directions, wherein when the first sliding element and the second sliding element are contacted with each other, the light beam is blocked by the first sliding element and the second sliding element.

20. The illuminated keyboard according to claim 18, at least one of the first sliding element and the second sliding element contains a light-transmissible zone, wherein while the keycap is moved toward the base plate, the first sliding element and the second sliding element are moved toward each other in opposite directions, wherein when the first sliding element and the second sliding element are contacted with each other, the light-transmissible zone is overlapped with the perforation, so that the light beam is transmitted through the perforation and the light-transmissible zone and outputted from the keycap.

21. The illuminated keyboard according to claim 20, wherein the light-transmissible zone is made of a non-transparent light-transmissible material.

22. The illuminated keyboard according to claim 18, wherein each key further comprises an elastic element, wherein the elastic element is arranged between the first sliding element and the second sliding element, and the first sliding element and the second sliding element are restored to original positions by the elastic element.

23. The illuminated keyboard according to claim 11, further comprising a frame, wherein the frame is disposed on the base plate and comprises plural openings, and the plural openings are respectively aligned with the plural keys, wherein the first sliding element and the second sliding element of each key is disposed within the corresponding opening.

24. The illuminated keyboard according to claim 23, wherein the plural keycaps are connected with the frame or the base plate.

25. The illuminated keyboard according to claim 23, wherein each key further comprises:

a first elastic element arranged between the first sliding element and a first sidewall of the corresponding opening, wherein the first sliding element is restored to an original position by the first elastic element; and a second elastic element arranged between the second sliding element and a second sidewall of the corresponding opening, wherein the second sliding element is restored to an original position by the second elastic element.

26. The illuminated keyboard according to claim 11, wherein the base plate further comprises plural guiding grooves corresponding to the plural first sliding elements and the plural second sliding elements.

* * * * *